United States Patent [19]

Klaren

[11] 4,398,594

[45] Aug. 16, 1983

[54] APPARATUS FOR USE IN CARRYING OUT A PHYSICAL AND/OR CHEMICAL PROCESS, FOR EXAMPLE A HEAT EXCHANGER

[75] Inventor: Dick G. Klaren, Hillegom, Netherlands

[73] Assignee: Esmil BV, Amsterdam, Netherlands

[21] Appl. No.: 376,024

[22] Filed: May 7, 1982

[30] Foreign Application Priority Data

May 12, 1981 [NL] Netherlands ..... 8102308

[51] Int. Cl.[3] ..... F28D 13/00

[52] U.S. Cl. ..... 165/104.16; 165/108; 165/40; 422/146; 422/139; 422/145; 34/57 A

[58] Field of Search ..... 422/146, 139–147; 34/57 A; 122/4 D; 134/104, 105, 111; 159/16 R, DIG. 3; 165/104.16, 108, 40; 110/245

[56] References Cited

U.S. PATENT DOCUMENTS

| | | | |
|---|---|---|---|
| 2,488,406 | 11/1949 | Hirsch | 422/146 X |
| 2,745,725 | 5/1956 | Ward et al. | 422/147 X |
| 3,505,111 | 4/1970 | Malek | 159/DIG. 3 |
| 3,642,452 | 2/1972 | Roget et al. | 165/108 X |
| 4,035,152 | 7/1977 | Yang et al. | 34/57 A X |
| 4,230,668 | 10/1980 | Sheely et al. . | |
| 4,246,231 | 1/1981 | Figler et al. | 422/147 |
| 4,296,800 | 10/1981 | Johnson | 165/104.16 X |

FOREIGN PATENT DOCUMENTS

| | | |
|---|---|---|
| 1118482 | 6/1956 | France . |
| 1183779 | 7/1959 | France . |
| 2089954 | 4/1971 | France . |
| 1348128 | 3/1974 | United Kingdom . |
| 2017280 | 10/1979 | United Kingdom . |
| 1589238 | 5/1981 | United Kingdom . |

*Primary Examiner*—Albert W. Davis, Jr.
*Attorney, Agent, or Firm*—Stevens, Davis, Miller & Mosher

[57] ABSTRACT

Apparatus for physical and/or chemical processes e.g. a heat exchanger, has a plurality of vertical riser tubes for upward flow of a liquid under treatment from a lower chamber to an upper chamber. A granular mass is fluidized by the flow so as to occupy at least the tubes. A return tube conveys the granular mass from the upper chamber to the lower chamber and has valve means to hinder flow of liquid through the return tube. To provide improved control of the liquid flow in the return tube, the valve means is embodied as a single valve having a valve member adjacent and movable relative to the lower end of the return tube.

6 Claims, 2 Drawing Figures

APPARATUS FOR USE IN CARRYING OUT A PHYSICAL AND/OR CHEMICAL PROCESS, FOR EXAMPLE A HEAT EXCHANGER

BACKGROUND OF THE INVENTION

1. Field of the Invention

The invention relates to an apparatus for use in carrying out a physical and/or chemical process, in particular a heat exchanger.

2. Description of the Prior Art

The applicants' Dutch patent application No. 80 06161 describes a heat exchanger having a bundle of parallel vertical riser tubes which are mounted in header plates and open into a lower tank and an upper tank. A granular mass (i.e. a particle mass) is present which can be fluidized during operation to occupy at least the tubes by a liquid medium flowing upwardly through the tanks and riser tubes. In addition there is at least one return tube for returning the granular mass from the upper tank to the lower tank, having valve means which hinder the passage of the liquid medium through the return tube. The valve means disclosed consists of a lock arrangement for the granules in the return tube, comprising two valves which are connected to each other, and can be opened and closed alternately. In this apparatus the purpose is to return a surplus of granules from the upper tank to the lower tank in batches without carrying out liquid with them. The return tube may be mounted near to or among the riser tubes.

In this apparatus, velocities of the liquid medium in the riser tubes are permissible which cause the granular mass to be transported upwards. These higher velocities permit a more attractive configuration of the riser tube bundle, so that the whole apparatus can be made narrower. Another advantage is that the higher velocities which can be achieved in the riser tubes result in an enhanced scouring and cleaning action of the granules on the tube walls. This permits applications in systems using liquids which have a pronounced fouling action, for instance, applications in the food processing industry and especially with liquids from which proteins can be deposited on the tube wall.

In this specification, by apparatus for the operation of a physical and/or chemical process (e.g. a heat exchanger), it is intended to mean apparatus in which physical and/or chemical processes are carried out on a liquid by the addition or removal of heat through the tube walls.

SUMMARY OF THE INVENTION

The object of the present invention is to provide a simplification of apparatus such as that described above. In addition it appears that the batch-wise return of the granules can give rise to an irregular operation of the process. At least the granular mass may be present in the return tube to a variable extent and thus there will be a varying quantity in the lower tank or the upper tank respectively.

Although in some cases, the efficiency of the heat transfer through the tube wall to, or from, the liquid medium is adversely affected by circulation in the apparatus via the return tube, and this must then be avoided by means of a lock system, it has appeared that in other cases the efficiency of this heat transfer is hardly affected by a small circulation of the liquid medium via the return tube.

This is associated inter alia with the manner of heat transfer between the outer walls of the tubes and a second heat transfer medium flowing over them. It is not necessary to go into the details of these phenomena since they belong to the general theory of heat transfer in heat exchangers.

The present invention consists in that the valve means controlling the return of the granular mass comprises a single valve with a valve member which is moveable with respect to the lower end of the return tube.

It appears that, with this valve in a partly open position, granules from the return tube can flow into the lower chamber but that a downward movement of the liquid medium does not necessarily occur at the same time, or at least only to a small extent. The velocity of the liquid medium in the return tube will adjust in dependence on the density of the liquid medium and of the granular mass and also on the mode of operation of the apparatus, the ratio of the diameters of the riser tubes and the return tube and on the valve aperture. This velocity may be variable from substantial to low in the downward direction, but it is also conceivable that it be zero, or even that there is a slight upward velocity in the return tube. The state of affairs which may actually prevail can be calculated by an expert on fluidized bed flow without great difficulty, or it can be determined empirically, or it may even be controlled by the choice of process conditions or by the choice of dimensions.

It is remarked here that as a rule the granular mass is only partly fluidized in the return tube, but will have a tendency to settle out at the valve. The height of the layer of granules settled out at the valve can also be affected by the process conditions, and also by the valve position, for instance.

Various forms of the valve construction are possible. For instance the valve member may be freely moving or driven, and it may be constituted of a material with a density so chosen that the valve in normal operating conditions remains free or driven. For this purpose the valve may be in the form of a ball valve, in which for instance a ball in a cage can carry out a small vertical displacement towards and away from the lower edge of the return tube. If at the start-up of the apparatus the liquid medium is conducted through the riser tubes, the valve will be pressed against the lower edge of the return tube, either by a buoyancy force and/or as a result of the powerful liquid flow, so that the return tube is sealed off from below. Only when subsequently a sufficient quantity of the liquid medium and a granular mass has been transported to the upper tank and has flowed from there back into the return tube, will the valve gradually open under the weight of the liquid/-granule mixture above, and as a result of the reduction of the upward flow pressure against the valve. As a result granules can then fall from the return tube into the lower tank.

A great advantage of the apparatus of the invention is that it is very easy to construct in comparison with the lock arrangement described above, and also that in normal operating conditions a very regular transport of granules from the return tube takes place, so that fluctuating operating conditions are avoided.

If it is difficult to adapt the construction and the material of the valve to the process conditions so that it constitutes a free floating or driven valve, a form a valve is preferred in which the valve member is spring biassed by a spring mounting e.g. on the frame of the apparatus. The valve may then be a disc valve (see below). This spring mounting can have many different forms. For instance it may be a mechanical spring construction, or a pneumatic or hydraulic device. The spring constant may be adjustable from outside, so that the apparatus can be used for many different operating conditions.

It is alternatively possible according to the invention that the valve member should be driven directly using control means which can be operated from outside the installation, without using a spring construction as an intermediate component. This arrangement has the further possibility of providing the apparatus with sensing means for the flow velocity of the liquid medium and/or the granular mass in the return tube and control means arranged to adjust the valve in response to a signal from the sensing means. This sensing means may for instance be arranged to measure a pressure drop along the return tube or between the upper chamber and the lower chamber. It may alternatively sense an acoustic signal, for instance coming from the moving granular mass. In fact any measurement can be used which in some way delivers a signal which is in a functional relationship with the flow velocity of the liquid medium and/or the granular mass in the return tube.

Where in this specification there is reference to a disc valve, the expression is to be taken to include conical valves, flat hinged valves and other rotationally symmetrical valve shapes.

BRIEF DESCRIPTION OF THE DRAWINGS

The preferred embodiments of the invention will now be described by way of non-limitative example and with reference to the accompanying drawings, in which.

DESCRIPTION OF THE PREFERRED EMBODIMENTS

Figure 1:
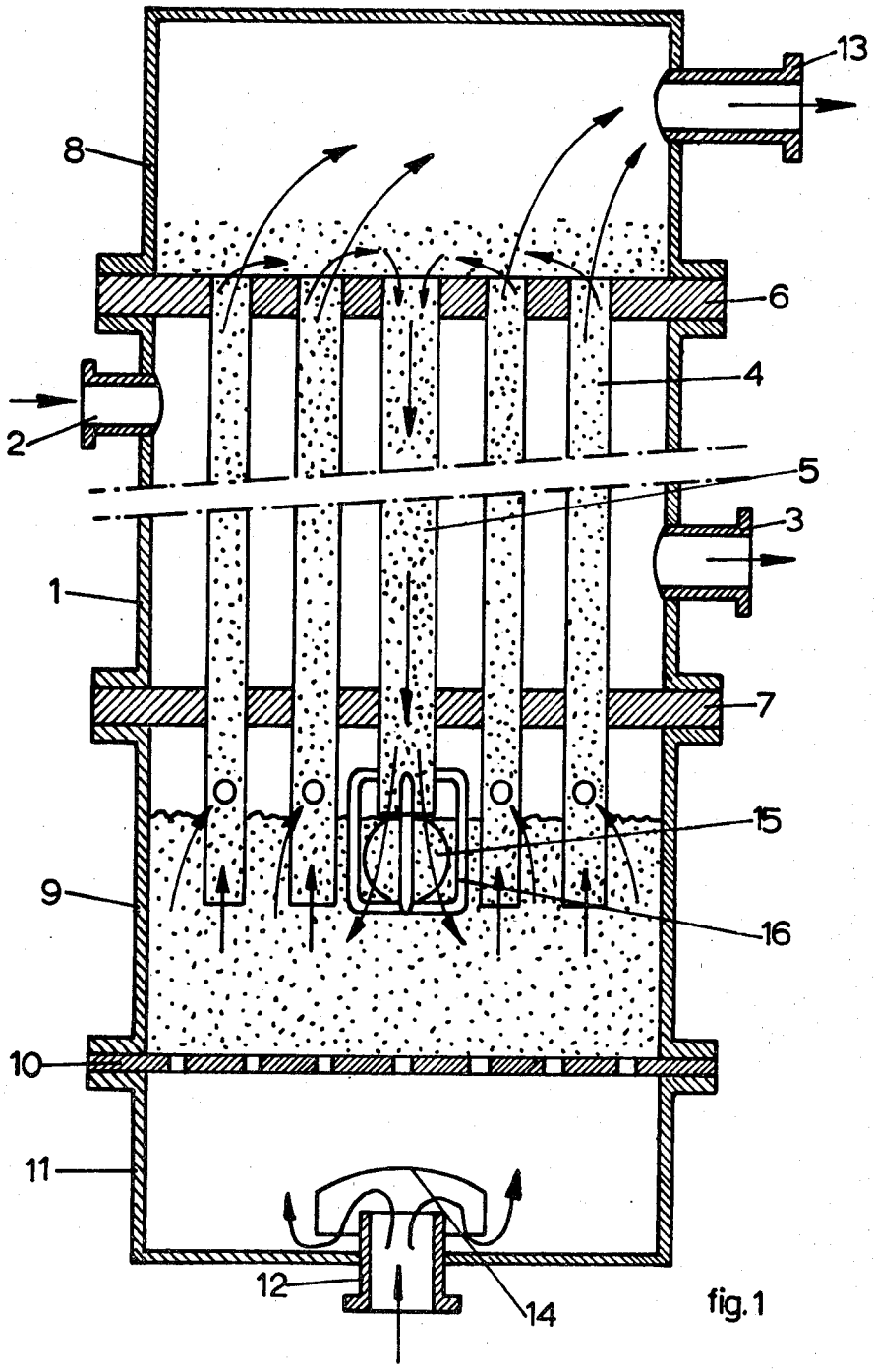
FIG. 1 shows schematically an embodiment of the apparatus according to the invention

FIG. 1 shows the casing 1 of a heat exchanger having an inlet opening 2 and an outlet opening 3 for a heat transfer medium. This medium flows over a bundle of vertical riser tubes 4 and a return tube 5. All these tubes 4,5 are mounted in tube header plates 6 and 7, and terminate beyond these in an upper chamber in the form of a tank 8 and a lower chamber in the form of a tank 9. In the system consisting of the lower chamber 9, the riser tubes 4 and the upper chamber 9, there is a granular mass which can flow over from the upper chamber 8 into the return tube 5. The lower chamber 9 is bounded below by an apertured flow distribution plate 10 which in turn forms the upper boundary of a second lower chamber 11.

The liquid which for example is to be heated by heat exchange through the walls of the tubes 4 with the medium outside the tubes 4 is introduced into the second lower chamber 11 via an inlet opening 12, and passes around the baffle 14 towards the flow distribution plate 10, which distributes it in the lower chamber 9. As a result of the flow of the liquid through the lower chamber 9, the granular mass is fluidized and propelled upwards through the riser tubes 4.

When the system is started up the liquid together with the granules will also attempt to ascend through the return tube 5. To control this, there is provided a ball valve comprising a ball valve member 15 mounted in a cage 16 at the lower end of the return tube 5. As a result of this upward flow, the ball 15 is moved vertically between the uprights of the cage 16 to engage the lower edge of the return tube 5. When the ball 15 so moves upwards, the tube 5 is closed, and the liquid and the granular mass can only rise via the riser tubes 4. The granules which arrive above the header plate 6 will after a short time descend via the return tube 5, and gradually build up an extra pressure on the ball 15, until the ball begins to sink under this load. The pellets can then flow back again from the return tube 5 into the lower chamber 9. The dimensions of the return tube 5 are in this embodiment so chosen relative to those of the riser tubes 4 that in a state of equilibrium almost no liquid flows down the return tube 5, but so that the granules sink down through the liquid in this tube and pass over the ball 15.

Figure 2:
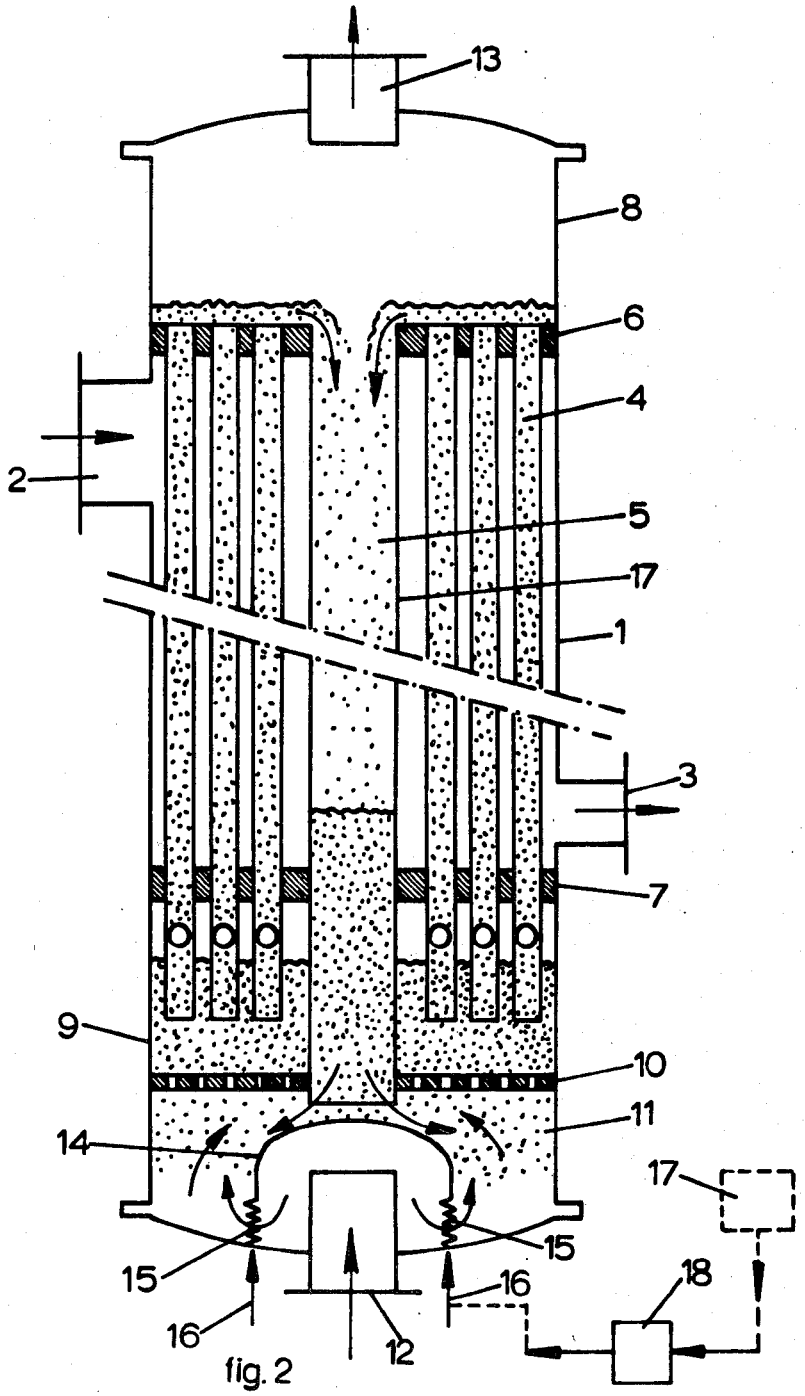
FIG. 2 shows a variation of the apparatus of FIG. 1.

FIG. 2 shows a modification of the apparatus of FIG. 1, in which the return tube 5 is extended to below the flow distribution plate 10, so that the granules can pass into the lower chamber 11. The dimensions of the holes in the distribution plate 10 are in this case so large that the granules are entrained by the liquid through these holes into lower chamber 9, and from there into the riser tubes 4. In the place of a ball valve, a disc valve is used, with the baffle 14 having the function of the valve member. This baffle 14 is mounted by springs 15 with the base of the apparatus. Arrows 16 indicate schematically that the springs 15 can be adjusted so that the spring characteristic is altered. Although the springs 15 are indicated as mechanical springs, they may alternatively be pneumatic or hydraulic springs.

A sensing device 17 is also shown schematically arranged to provide a signal representing the velocity of the liquid and/or the granules in the downcomer 5. This signal may for instance represent a pressure or an acoustic signal as discussed above.

It is shown schematically in FIG. 2 that the signal from the sensing device 17 is fed to a control device 18, and a signal from this is fed to the adjustment means 16 for the springs 15, so that the valve is adjusted in dependence on the flow rate in the return tube. In a small modification (not shown in the figure) the adjustment signal can also be caused to move the baffle 14 directly, so as to get an adjustment of the baffle proportional to the output signal of the sensing means. In this way it is possible to control the position of the baffle 14 so that it is dependent on the state of the process being performed in the apparatus, resulting in the most nearly constant running of the process.

What is claimed is:

1. In apparatus for use in carrying out a physical and/or chemical process having a plurality of upwardly extending riser tubes for upward flow of a liquid and upper and lower chambers into which said tubes open at their upper and lower ends respectively, the apparatus containing a granular mass which is fluidized by the upward flow of the said liquid so as to occupy at least the riser tubes, and there being at least one return tube for the return of the granular mass from the upper chamber to the lower chamber and valve means hindering the passage of liquid through said return tube, the improvement that said valve means is a single valve having a valve member adjacent to and movable relative to the lower end of the return tube.

2. Apparatus according to claim 1 wherein the said valve member is freely movable and is such as to remain buoyant in the liquid in normal operating conditions.

3. Apparatus according to one of claims 1 and 2 wherein the valve member is a ball.

4. Apparatus according to claim 1 wherein the valve member is spring-biassed in its closing direction by a spring mounting.

5. Apparatus according to claim 1 having control means for operation of said valve.

6. Apparatus according to claim 5 wherein said control means includes sensing means for the flow velocity of the liquid and/or the granular mass in the said return tube and adjustment means arranged to operate said valve in dependence on the output of the sensing means.

* * * * *